US006648235B2

(12) United States Patent
Chan

(10) Patent No.: US 6,648,235 B2
(45) Date of Patent: Nov. 18, 2003

(54) CONTROL METHOD OF THERMOSTATIC SYSTEM

(75) Inventor: Nien-Feng Chan, Taipei Hsien (TW)

(73) Assignee: Guard Sound Industry Co., Ltd., Taipei (TW)

( * ) Notice: Subject to any disclaimer, the term of this patent is extended or adjusted under 35 U.S.C. 154(b) by 0 days.

(21) Appl. No.: 10/117,173

(22) Filed: Apr. 8, 2002

(65) Prior Publication Data

US 2003/0189103 A1 Oct. 9, 2003

(51) Int. Cl.[7] ..... G05D 23/00; F23N 1/08

(52) U.S. Cl. ..... 236/25 A; 236/80 A; 122/14.22; 122/14.31

(58) Field of Search ..... 236/5 AF, 26 A, 236/80 F, 80 E, 80 G; 122/14.22, 14.31

(56) References Cited

U.S. PATENT DOCUMENTS 2,685,411 A * 8/1954 Penn et al. ..... 236/80 F 4,627,416 A * 12/1986 Ito et al. ..... 236/55 A

* cited by examiner

*Primary Examiner*—William Wayner

(74) *Attorney, Agent, or Firm*—Rosenberg, Klein & Lee

(57) ABSTRACT

A control method of a thermostatic system for a hot water heater is provided where when the water temperature in the hot water heater is too large, a first electromagnetic valve is controlled to be open and a second electromagnetic valve is controlled to be closed. Gas will be transferred via the first gas room to the second gas room. The control of the electromagnetic valves causes a decrease in gas outflow to the hot water heater. When the water temperature in the hot water heater is too small, the first electromagnetic valve is controlled to be closed and the second electromagnetic valve is controlled to be open. The further control of the electromagnet valves causes an increase in the open degree of a gas outlet valve, hence increasing gas outflow.

1 Claim, 6 Drawing Sheets

CONTROL METHOD OF THERMOSTATIC SYSTEM

FIELD OF THE INVENTION

The present invention relates to a control method of a thermostatic system and, more particularly, to a control method applicable to a water heater, wherein two electromagnetic valves are exploited to exactly control gas outflow at the gas outlet. Thereby, thermostatic control of the water heater can be achieved.

BACKGROUND OF THE INVENTION

As shown in FIG. 1, a gas switch control system 10 is installed in a prior art water heater. The gas switch control system 10 comprises a gas inlet 11 for inputting gas, a first gas outlet 12 for outputting gas to a main stove, and a second gas outlet 13 for outputting gas to a pilot flame. A valve 14 is arranged between the gas inlet 11 and the first gas outlet 12 and the second gas outlet 13. The action of the valve 14 is controlled by a water pan 15. When cold water is input from a cold water inlet 16 into the water pan 15, the valve 14 will be pushed open so that gas can be transferred from the gas inlet 11 to the first gas outlet 12 and the second gas outlet 13.

A switch middle seat 17 is installed between the first gas outlet 12 and the second gas outlet 13. The switch middle seat 17 comprises an upper lid 18 and a bottom seat 19, which are assembled to form a hollow shell. A valve sheet 20 made of resilient material such as rubber is installed in the switch middle seat 17. The valve sheet 20 is fixedly gripped between the upper lid 18 and the bottom seat 19. The valve sheet 20 is connected to a connecting link 21. One end of the connecting link 21 has a valve 22. The valve 22 can be used to control the open or close of the first gas outlet 12.

The valve sheet 20 partitions the switch middle seat 17 into a first gas room 23 and a second gas room 24. A first electromagnetic valve 25 and a second electromagnetic valve 26 are installed on the side wall of the second gas room 24. The first electromagnetic valve 25 is normally open and situated between the first gas room 23 and the second gas room 24. The first electromagnetic valve 25 can be used to control the open or close state between the first gas room 23 and the second gas room 24. The second electromagnetic valve 26 is normally close and situated between the second gas room 24 and the second gas outlet 13. The second electromagnetic valve 26 can be used to control the open or close state between the second gas room 24 and the second gas outlet 13, i.e., the open or close of the second gas outlet 13.

When cold water is input from the cold water inlet 16 into the water pan 15, the valve 14 will be pushed open through the water pan 15. Therefore, gas can be transferred from the gas inlet 11 into the first gas room 23 of the switch middle seat 17. Gas can also be transferred via the first electromagnetic valve 25 at open state to the second gas room 24. At this time, the second electromagnetic valve 26 can be controlled to be open so that gas can be transferred to the pilot flame via the second gas outlet 13, hence facilitating action of ignition. When the pilot flame has been ignited, the first electromagnetic valve 25 can be controlled to be close so that gas in the second gas room 24 will be gradually burned out. At this time, the gas pressure in the first gas room 23 will be larger than that in the second gas room 24. Therefore, gas will push the valve sheet 20 to move toward the direction of the second gas room 24. The valve 22 will be jointly moved toward the direction of the switch middle base 17 through the connecting link 21. The first gas outlet 12 can thus be controlled to be open so that gas can be output via the first gas outlet 12 to the main stove.

However, in the above gas switch control system 10 of prior art, the first electromagnetic valve 25 and the second electromagnetic valve 26 can only make a simple on or off action. Gas outflow of the first gas outlet 12 output to the main stove can not be exactly controlled so that thermostatic control of the water heater can not be achieved.

SUMMARY AND OBJECTS OF THE PRESENT INVENTION

The primary object of the present invention is to provide a control method of a thermostatic system, wherein two electromagnetic valves of a thermostatic system of a water heater can be controlled to perform the control of gas charge and discharge of a second gas room so as to push a valve sheet forwards or backwards. Thereby, gas outflow of a first gas outlet output to a hot water heater can be exactly controlled so that the linkage with temperature change of the water heater is more apparent. Thermostatic control of the water heater can thus be achieved.

To achieve the above object, the present invention provides a control method of a thermostatic system. When gas outflow output to a main stove is too large, the first electromagnetic valve is controlled to be open and the second electromagnetic valve is controlled to be closed. Gas will be transferred from the first gas room to the second gas room. The control of gas charge of the second gas room is thus performed so as to decrease the open degree of the first gas outlet used to output gas to the hot water heater, hence decreasing gas outflow. When gas outflow output to the hot water heater is too small, the first electromagnetic valve is controlled to be closed and the second electromagnetic valve is controlled to be open. Gas cannot be transferred to the second gas room, and gas in the second gas room can be output via the second gas outlet used to output gas to a pilot flame. The control of gas discharge of the second gas room is thus performed so as to increase the open degree of the first gas outlet, hence increasing gas outflow.

The various objects and advantages of the present invention will be more readily understood from the following detailed description when read in conjunction with the appended drawings, in which:

DETAILED DESCRIPTION OF PREFERRED EMBODIMENT

Figure 1:
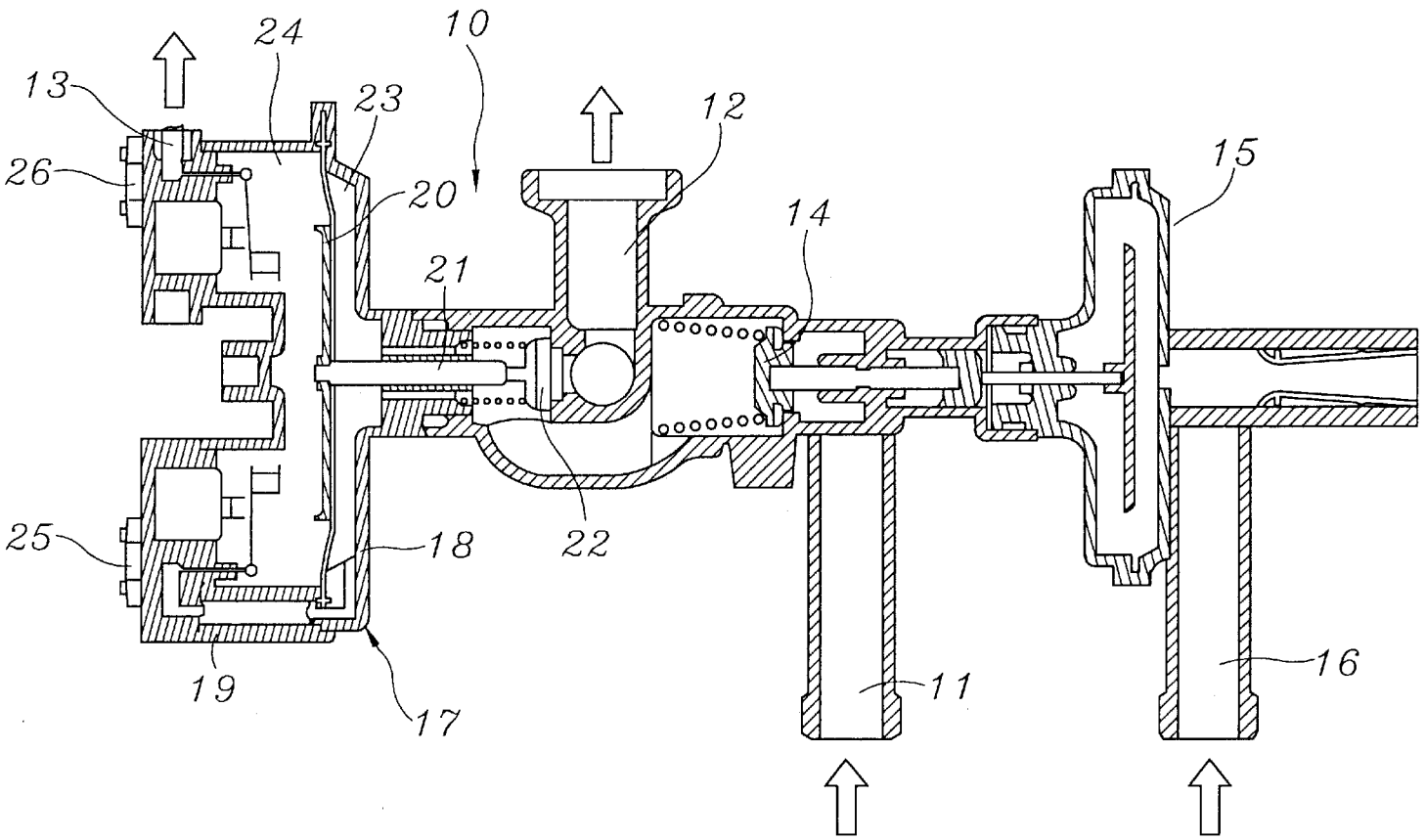
FIG. 1 PRIOR ART
FIG. 1 is a cross-sectional view of a gas switch control system in prior art.
Figure 2:
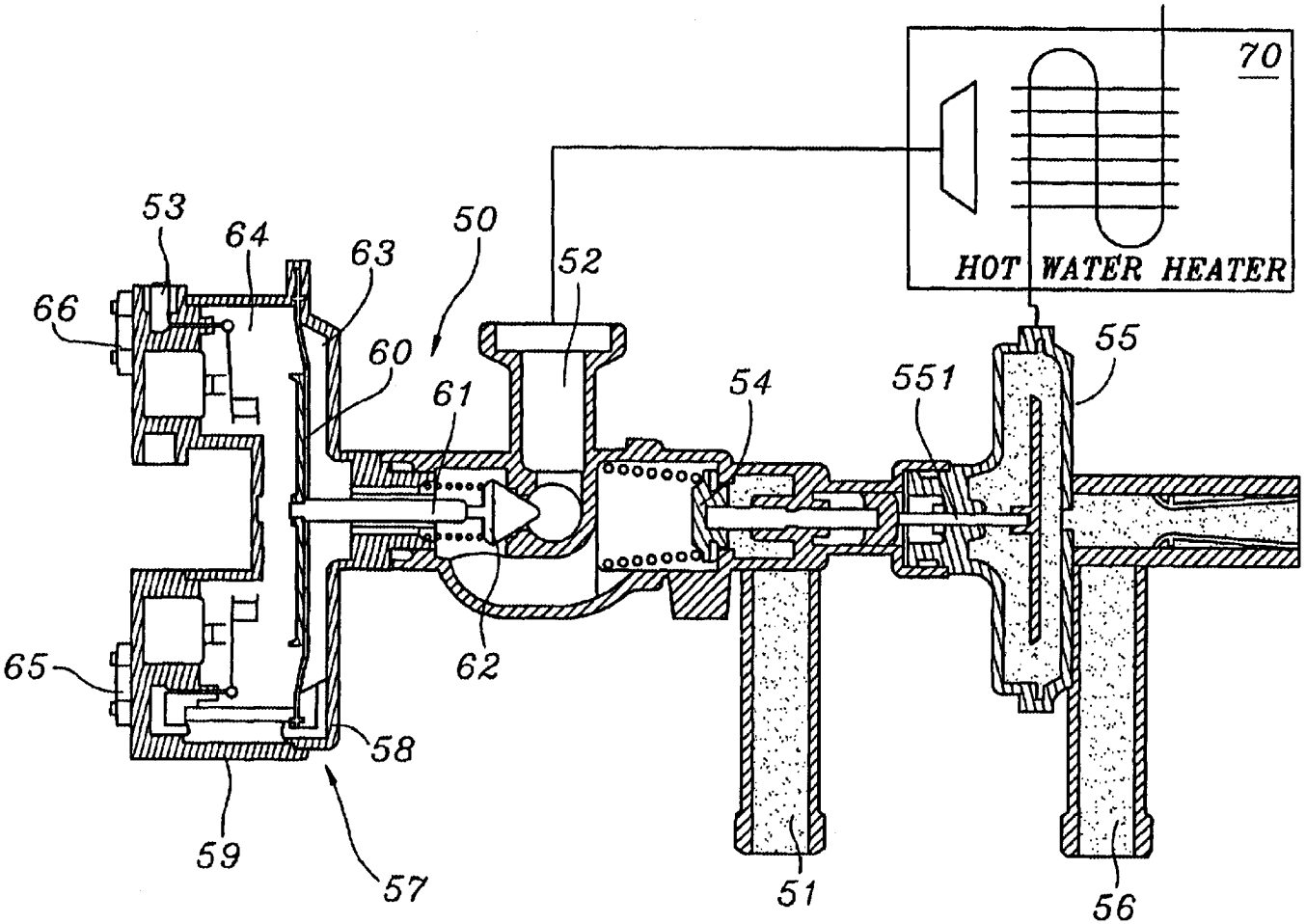
FIG. 2 is a cross-sectional view of the present invention when not used.

The present invention relates to a control method of a thermostatic system as shown in FIG. 2. The present invention is applicable to a thermostatic system 50 of a general hot water heater 70. The thermostatic system 50 is roughly like a gas switch control system of prior art. The thermostatic system 50 comprises a gas inlet 51 for inputting gas, a first gas outlet 52 for outputting gas to hot water heater 70, and a second gas outlet 53 for outputting gas to a pilot flame. A valve 54 is arranged between the gas inlet 51 and the first gas outlet 52 and the second gas outlet 53. The action of the valve 54 is controlled by a thimble 551 of a water pan 55. The water pan 55 has a cold water inlet 56. When cold water is input from the cold water inlet 56 into the water pan 55, the thimble 551 will be jointly moved so that the valve 54 will be pushed open to let gas be transferred from the gas inlet 51 to the first gas outlet 52 and the second gas outlet 53.

A switch middle seat 57 is installed between the first gas outlet 52 and the second gas outlet 53. The switch middle seat 57 comprises an upper lid 58 and a bottom seat 59, which are assembled to form a hollow shell. A valve sheet 60 made of resilient material such as rubber is installed in the switch middle seat 57. The valve sheet 60 is fixedly gripped between the upper lid 58 and the bottom seat 59. The valve sheet 60 is connected to a connecting link 61. One end of the connecting link 61 has a valve 62. The valve 62 can be used to control the open or close and the gas flux of the first gas outlet 52.

The valve sheet 60 partitions the switch middle seat 57 into a first gas room 63 and a second gas room 64. A first electromagnetic valve 65 and a second electromagnetic valve 66 are installed on the side wall of the second gas room 64. The first electromagnetic valve 65 is normally open and situated between the first g as room 63 and the second gas room 64. The first electromagnetic valve 65 can be used to control the open or close state between the first gas room 63 and the second gas room 64. The second electromagnetic valve 66 is normally close an d situated between the second gas room 64 and the second gas outlet 53. The second electromagnetic valve 66 can be used to control the open or close state between the second gas room 64 and the second gas outlet 53, i.e., the open or close of the second gas outlet 53.

Figure 3:
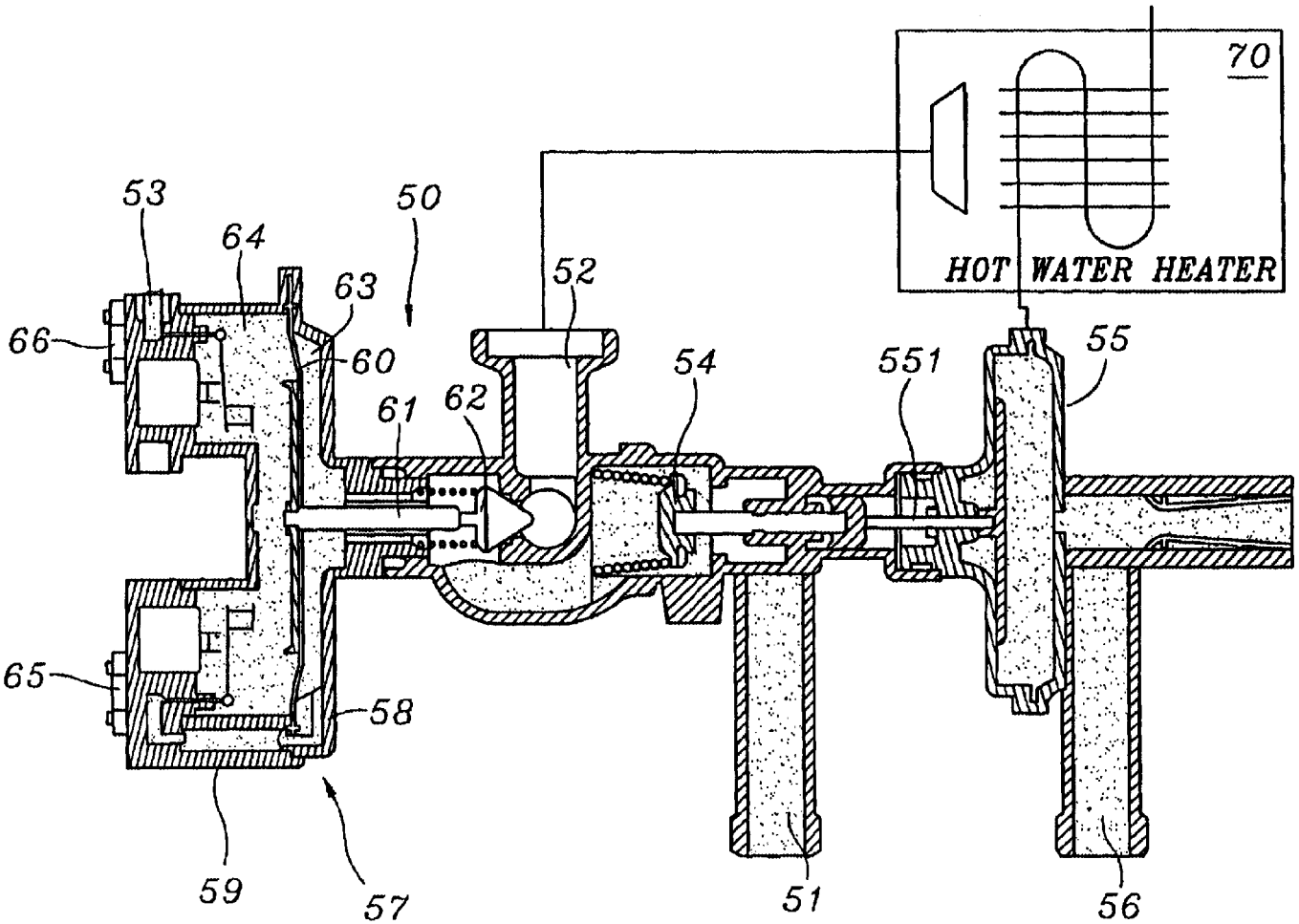
FIG. 3 is a cross-sectional view of the present invention when being ignited.

As shown in FIG. 3, when cold water is input from the cold water inlet 56 into the water pan 55, the valve 54 will be pushed open through the thimble 551 of the water pan 55. Therefore, gas can be transferred from the gas inlet 51 into the first gas room 63 of the switch middle seat 57. Gas can also be transferred via the first electromagnetic valve 65 at open state to the second gas room 64. At this time, the second electromagnetic valve 66 can be controlled to be open so that gas can be transferred to the pilot flame via the second gas outlet 53, hence facilitating action of ignition.

Figure 4:
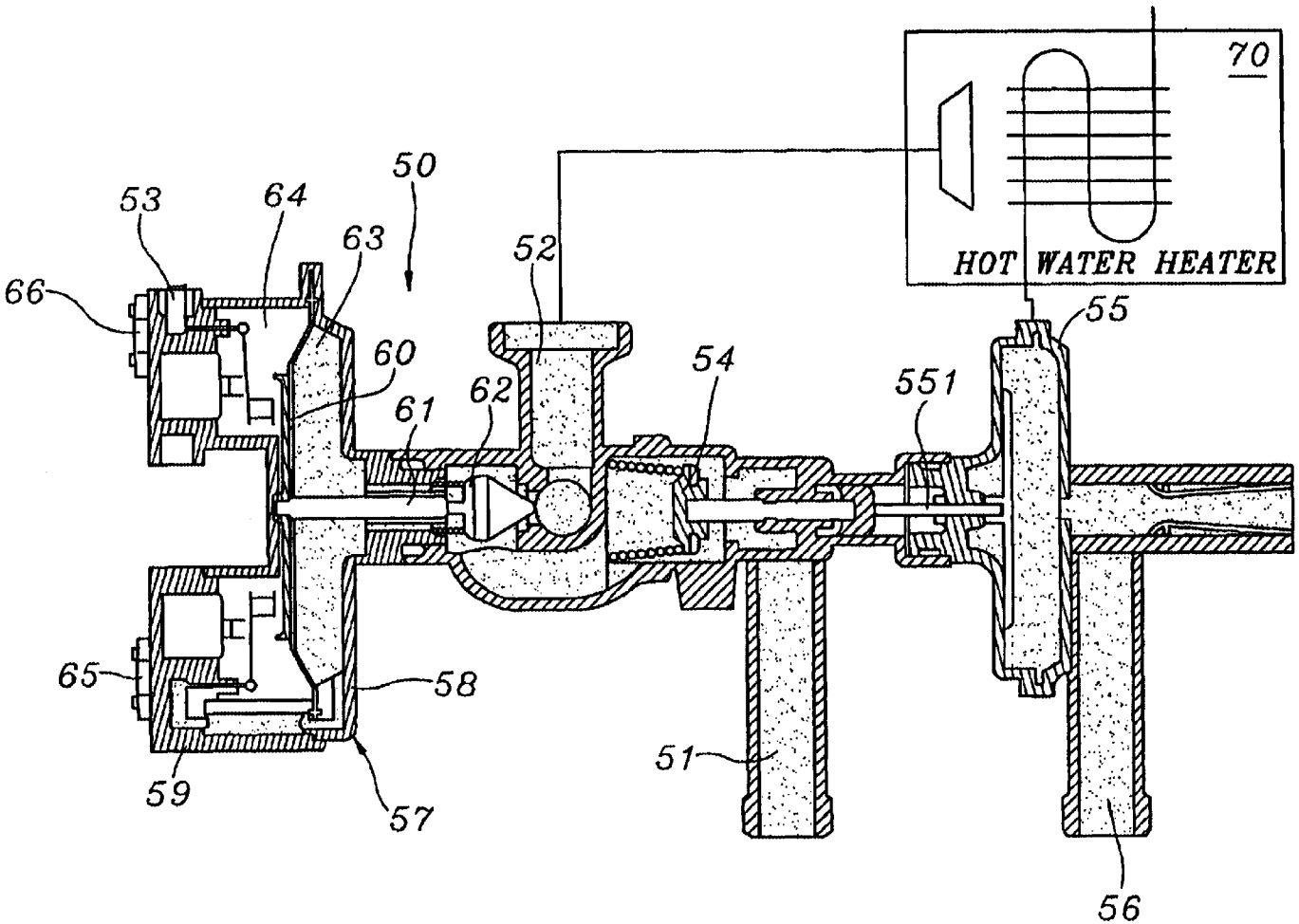
FIG. 4 is a cross-sectional view of the present invention after being ignited.

As shown in FIG. 4, when the pilot flame has been ignited, the first electromagnetic valve 65 can be controlled to be closed so that gas in the second gas room 64 will be gradually burned out. At this time, the gas pressure in the first gas room 63 will be larger than that in the second gas room 64. Therefore, gas will push the valve sheet 60 to move toward the direction of the second gas room 64. The valve 62 will be jointly moved toward the direction of the switch middle base 57 through the connecting link 61. The first gas outlet 52 can thus be controlled to be open so that gas can be output via the first gas outlet 52 to the hot water heater 70.

Figure 5:
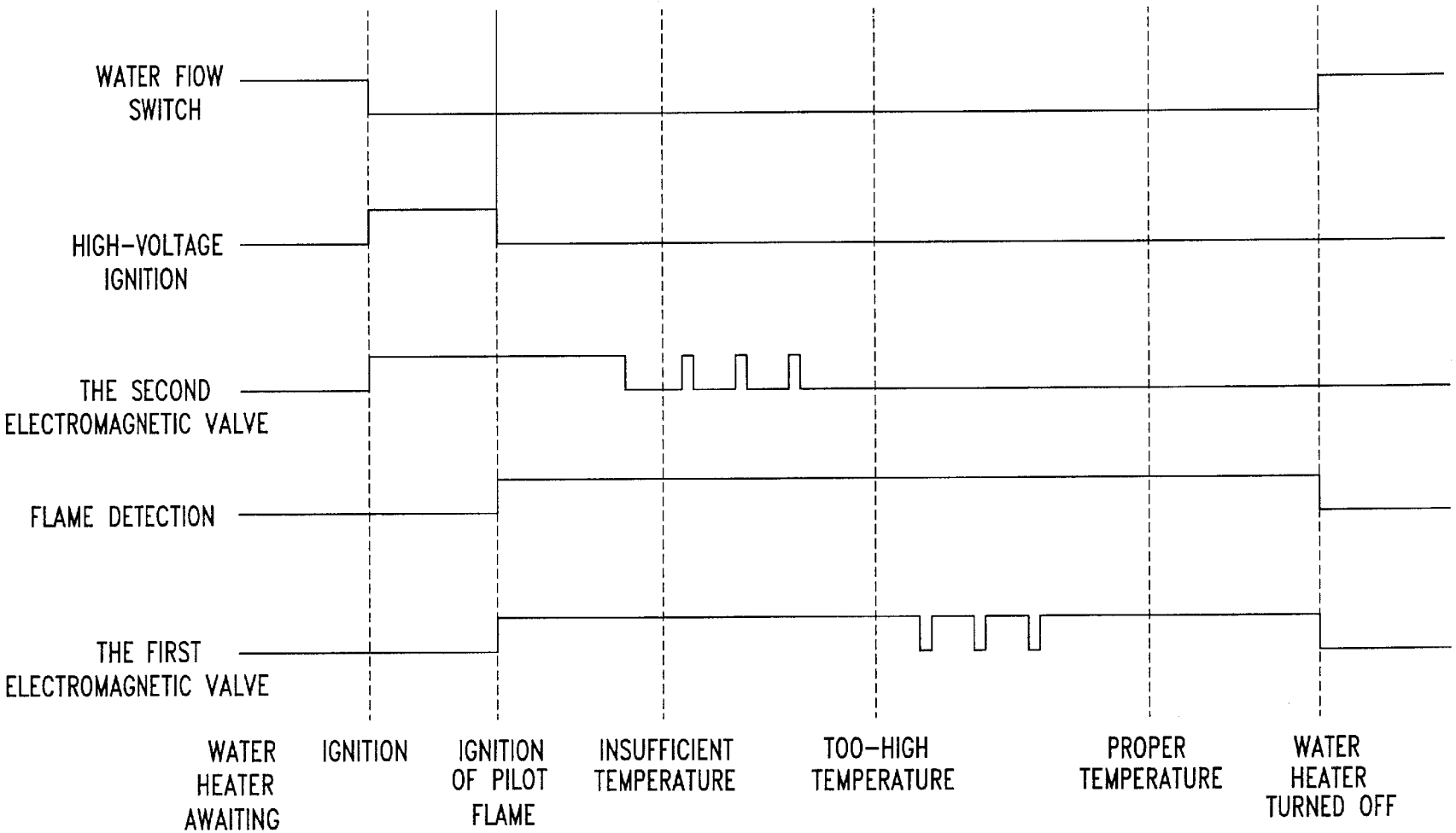
FIG. 5 is a timing diagram of the control method of the present invention.
Figure 6:
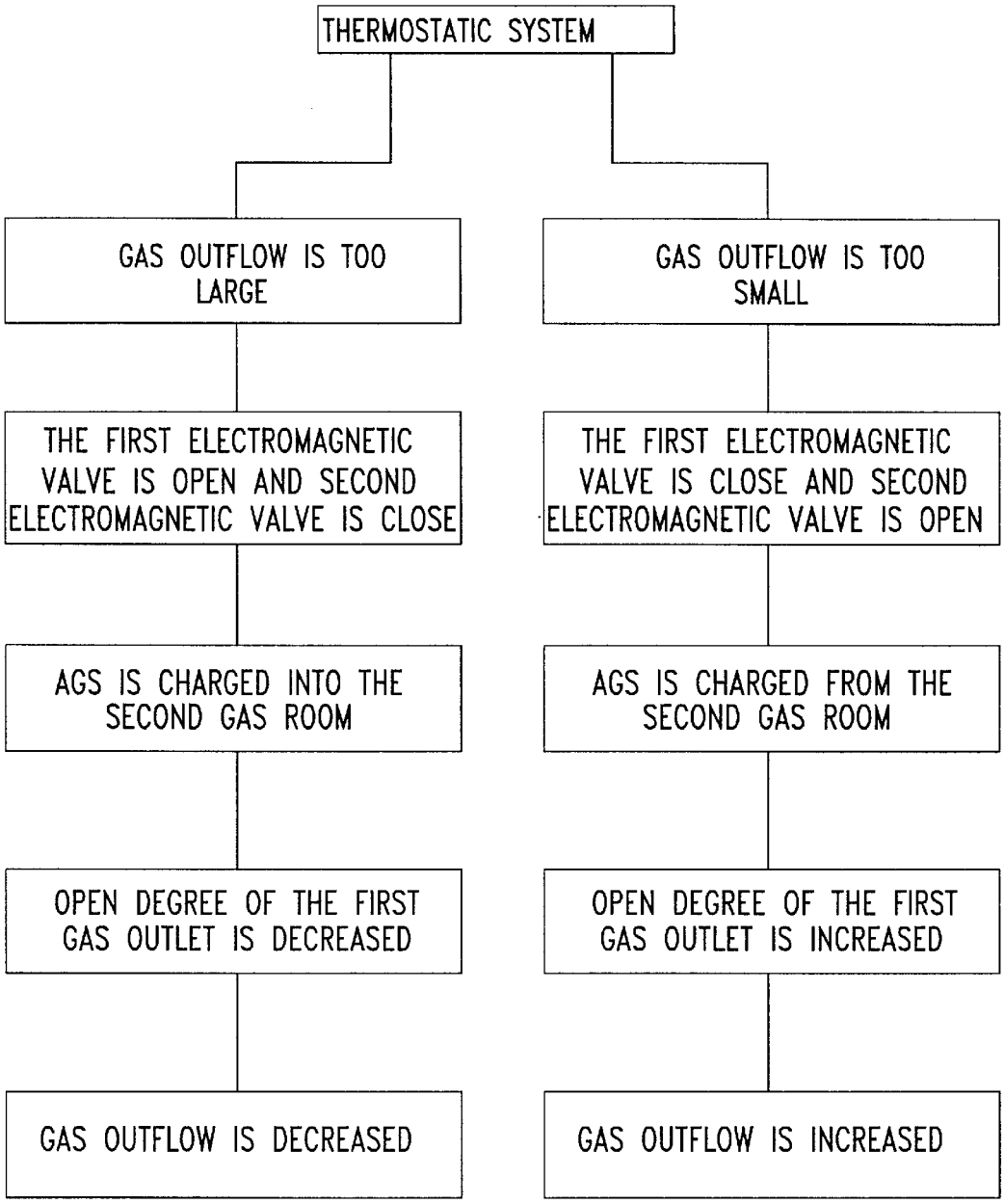
FIG. 6 is a block diagram of the control method of the present invention.

The first electromagnetic valve 65 and the second electromagnetic valve 66 can be properly controlled in the present invention so that they cannot only make a simple on or off action. As shown in FIGS. 5 and 6, when a water temperature sensor detects the temperature is too high indicating gas outflow output to the hot water heater 70 is too large, the first electromagnetic valve 65 is controlled to be open and the second electromagnetic valve is controlled to be closed. Gas can be transferred via the first gas room 63 to the second gas room 64. The control of gas charge of the second gas room 64 is thus performed to increase the gas pressure in the second gas room 64 so that the valve sheet 60 will be pushed to move toward the direction of the first gas room 63. The valve 62 will be jointly moved toward the direction oft he first gas outlet 52 through the connecting link 61 to decrease the open degree of the first gas outlet 52, hence decreasing gas outflow output to the main stove. When the water temperature sensor detects the temperature is too low (insufficient) indicating gas outflow output to the hot water heater 70 is too small, the first electromagnetic valve 65 is controlled to be closed and the second electromagnetic valve 66 is controlled to be open. Therefore, gas cannot be transferred to the second gas room 64, and gas in the second gas room 64 can be output via the second gas outlet 53. The control of gas discharge of the second gas room 64 is thus performed to let the gas pressure in the second gas room 64 decrease so that the gas pressure in the first gas room 63 will be larger than that in the second gas room 64. The valve sheet 60 will be pushed to move toward the direction of the second gas room 64. The valve 62 will be jointly moved toward the opposite direction of the first gas outlet 52 through the connecting link 61 to increase the open degree of the first gas outlet 52, hence increasing gas outflow output to the main stove. When water is kept at a proper temperature, the first electromagnetic valve 65 and second electromagnetic valve 66 are controlled to be closed, as illustrated in FIG. 5.

To sum up, the control of gas charge and discharge of the second gas room 64 can be performed by controlling the two electromagnetic valves 65 and 66. The valve sheet 66 can be pushed to move forwards or backwards so that gas outflow of the first gas outlet 52 output to the main stove can be exactly controlled. Thermostatic control of the hot water heater 70 can thus be achieved.

I claim:

1. A control method of a thermostatic system for a hot water heater, comprising the steps of:

a. providing a thermostatic system having a gas inlet for input of gas, a first gas outlet for supplying gas to a hot water heater, a water inlet for receiving for input of cold water, and a water outlet for fluid communication with the hot water heater, said thermostatic system having (1) a water pan coupled in fluid communication with said water inlet and said water outlet, said water pan having a thimble coupled to a first gas-valve for passing gas from said gas inlet to a chamber responsive to cold water being input to said water pan from said water inlet, (2) a second gas valve disposed between said chamber and said gas outlet, said second gas valve being adapted to provide proportional gas flow from said chamber to said gas outlet, (3) a switch seat coupled in fluid communication with said chamber for receiving gas therefrom, said switch seat having a first gas room and a second gas room partitioned by a diaphragm, said diaphragm being coupled to said second gas valve by a connecting link, said first gas room being in fluid communication with said chamber (4) a first electro magnetic valve having a inlet coupled in fluid communication with said first gas room and an outlet coupled in fluid communication with said second gas room, and (5) a second electromagnetic valve having a inlet coupled in fluid communication with said second gas room and an outlet thereof coupled in fluid communication with a second gas outlet;

b. controlling said first electromagnetic valve to be open and said second electromagnetic valve to be closed to thereby transfer gas from said first gas room to said second gas room and equalize pressure on opposing sides of said diaphragm to close said second gas valve;

c. controlling said first electromagnetic valve to be closed and said second electromagnetic valve to be open to transfer gas from said second gas room to said second gas outlet, responsive to said transfer of gas from said second gas room said diaphragm is displaced toward said second room to proportionally open said second gas valve and thereby transfer gas to said first gas outlet; and, d. controlling said first and second electromagnetic valves to close responsive to water in the hot water heater is within a predetermined temperature range, repeating step c responsive to the water in the hot water heater being lower than said predetermined temperature range, repeating step b responsive to the water in the hot water heater being higher than said predetermined temperature range.

* * * * *